United States Patent [19]

Peters

[11] 4,428,709

[45] Jan. 31, 1984

[54] DE-PACKAGING APPARATUS

[75] Inventor: Alan R. Peters, Stratford, Conn.

[73] Assignee: Automation International Corp., Norwalk, Conn.

[21] Appl. No.: 211,034

[22] Filed: Nov. 28, 1980

[51] Int. Cl.[3] ..... B65B 69/00

[52] U.S. Cl. ..... 414/412; 53/381 R; 83/228; 83/689; 221/74

[58] Field of Search ..... 414/412; 221/71-74; 53/381 R; 83/103, 25, 228, 227, 689, 685-688

[56] References Cited

U.S. PATENT DOCUMENTS

| | | | |
|---|---|---|---|
| 2,067,943 | 1/1937 | Nordquist | 83/228 |
| 2,122,368 | 6/1938 | Englen | 83/25 X |
| 3,524,370 | 8/1970 | Thompson | 83/685 X |
| 3,974,939 | 8/1976 | Melton | 414/412 X |
| 4,034,877 | 7/1977 | Bennison | 414/412 |

*Primary Examiner*—Richard A. Schacher
*Attorney, Agent, or Firm*—William G. Rhines

[57] ABSTRACT

This invention is in the field of automatic machinery and in one embodiment useful for removing the contents of "blister" packages in ribbon form, comprises a group of three in-line die blocks, which move together in a square motion, having a lateral distance of motion equal to the distance between blister packs on a common ribbon. Sequentially, the first is a positioning die, the second includes a bottom-positioned upward moveable perforating die to perforate an exit hole in the bottom of the package, and the third includes a top positioned downward moveable punch for impinging on the top of the blister and forcing the contents of the package out through the perforated exit hole.

13 Claims, 10 Drawing Figures

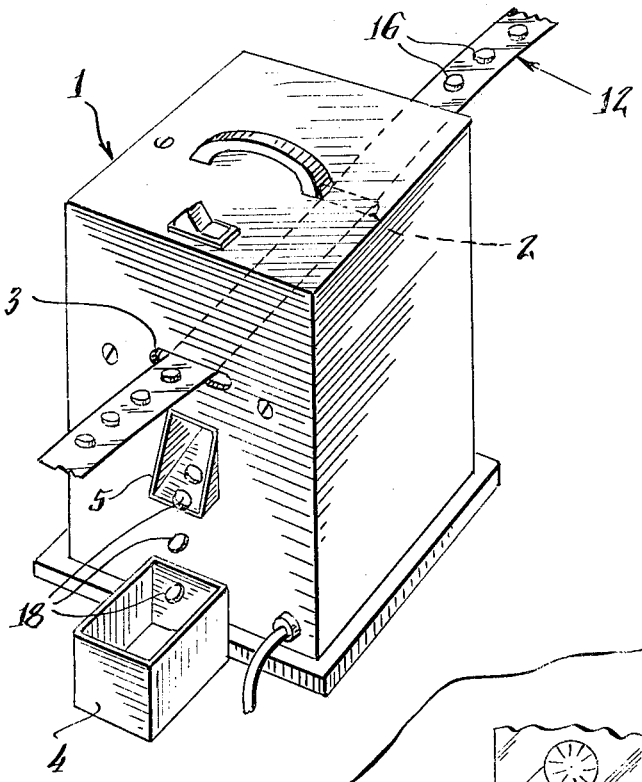
Fig. 1.
Fig. 4.
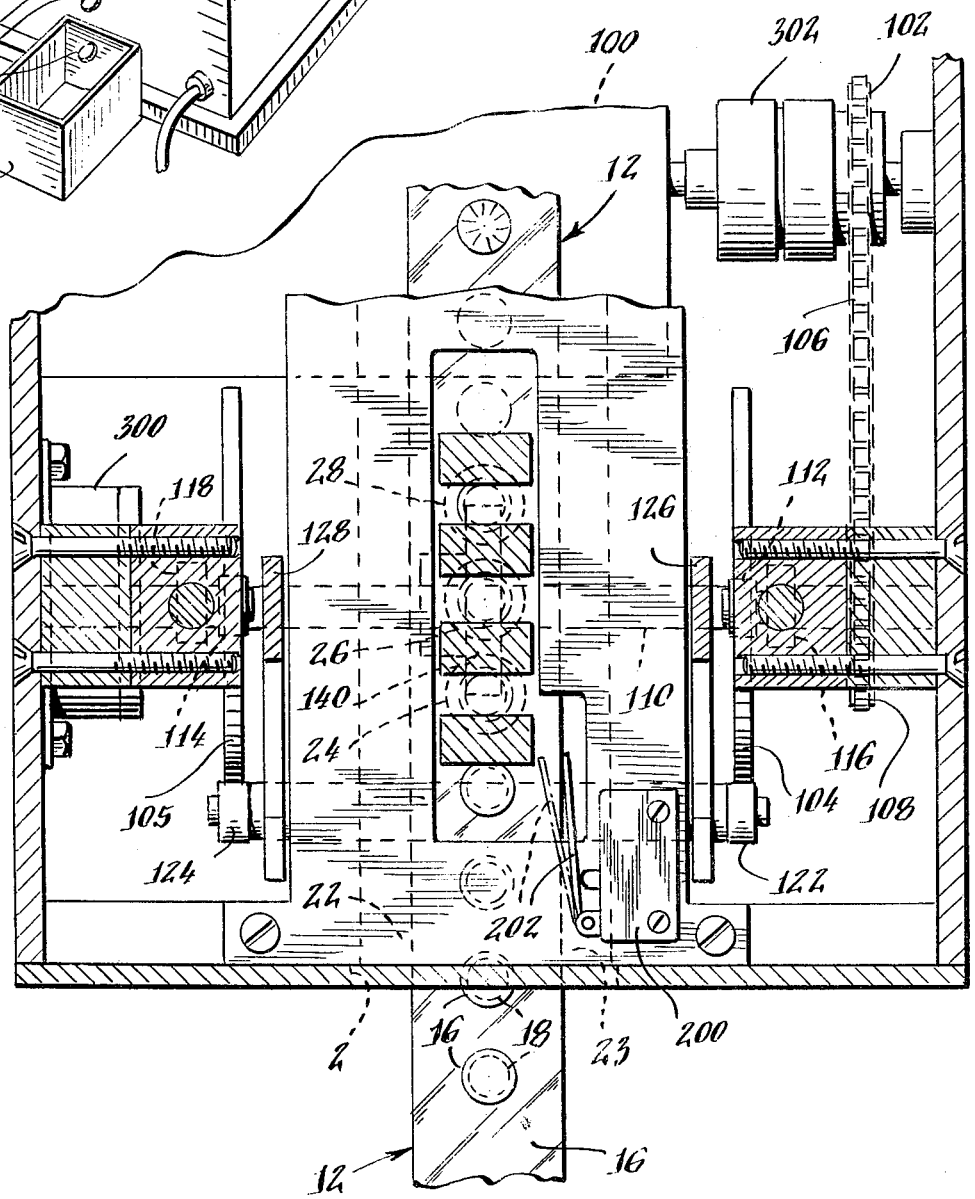

DE-PACKAGING APPARATUS

BACKGROUND OF INVENTION

A recent innovation in the packaging field is the pre-packaging of items which previously were sold singly or in bulk. For example, screws, hinges, pills and other pharmaceuticals, ribbon and other sewer's supplies, kitchen utensils and other household supplies, foodstuffs, dental supplies, and a wide variety of other goods now frequently are packaged using automatic machinery, by positioning them between strips of material which are then bonded to each other. Typically, such packaging may take the form of a so-called "blister pack" in which the bottom strip is more or less flat while the top strip in the region of each unit is formed into a domed contour to accomodate the object which it contains. Such "bubbles" may be preformed, or may be formed as the strips are joined together. It has been found particularly advantageous to make them from clear plastic material since such material may be made sufficiently rigid to provide a defined housing in which the object may reside without the bubble itself bearing directly thereon with too high a pressure, and since it affords good and unobstructed viewing of the package contents. It is also known to produce such packages in the form of continuous strips. Thus, for example, it has become a practice to package medication, vitamins, and other pharmaceutical products in pill form of pre-determined dosage in long strips of blister packs, which are severable from each other, have a substantially flat cardboard base, and have a clear domed plastic sheet laminated to the top of the base to form a series of compartments for the products being packaged.

Recently there has emerged a need for removing the contents of such blister packs by automated machinery. Thus, for example, if a product is to be taken off the market and it is desired to recover all of the material so as to destroy it, or if the written matter included in the package is erroneous but the contents are good and of sufficient value, it is desired to recover the contents by fast, effective, inexpensive means, in order to avoid the cost and other objections of doing so manually.

Accordingly, it is an object of this invention to provide a means for removing the contents of blister packs.

Another objective is to provide such means in a form which may be automated.

DESCRIPTION OF INVENTION

Desired objectives may be achieved through practice of the present invention, embodiments of which includes means for puncturing the outline of an egress hole in the base of a blister pack and means for impinging upon the top of the pack to force the contents thereof through said egress hole. Other embodiments include means for causing said puncturing means and said impinging means to move cooperatively, and other embodiments include means for positioning said packs to facilitate operation of said impinging means and said puncturing means.

DESCRIPTION OF DRAWINGS

This invention may be understood from the description which follows and from the accompanying drawings in which FIG. 1 is a perspective view of an embodiment of this invention, FIG. 4 is a top view of detail in the embodiments of the invention shown in FIGS. 1 through 3.

DESCRIPTION OF PREFERRED EMBODIMENTS

Figure 2:
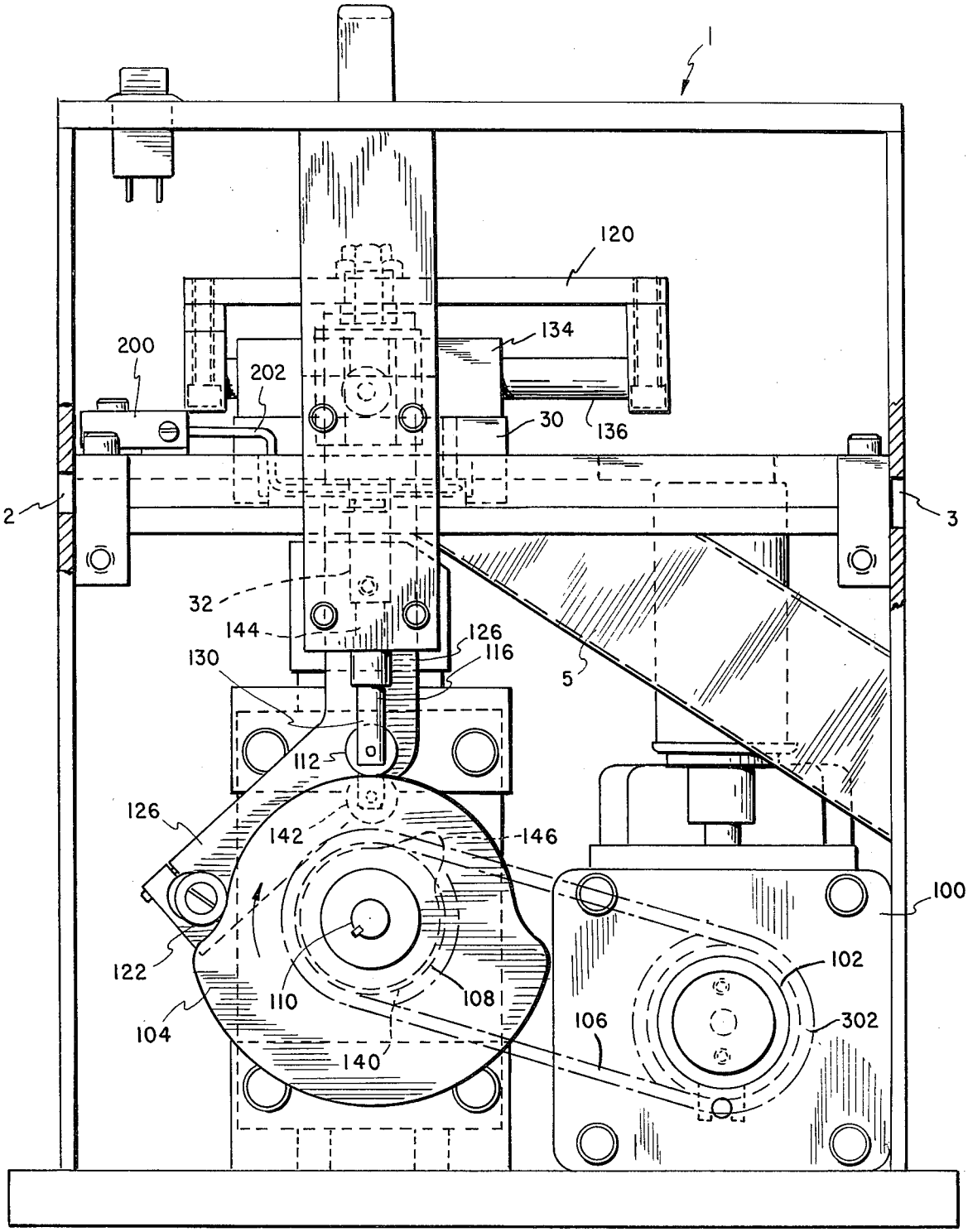
FIG. 2 is a side view of drive mechanisms comprising the embodiment of this invention shown in FIG. 1.

Referring first to FIG. 1, there is illustrated a device which embodies the present invention. This embodiment is particularly adapted for use in removing the contents of a continuous strip of blister packs 12. The latter each consist of a cardboard base 14 with a domed, thermoformed "blister" 16 bonded thereto, housing the contents, in this case pills 18. In the device 10, the blister pack strip is received into the machine 1, through an ingress slot 2, processed as hereinafter described to remove the packaged contents therefrom and the base 14 and blister strip 16 of the tape so stripped are fed out the opposite end of the machine to be discarded via egress slot 3.

Figure 3:
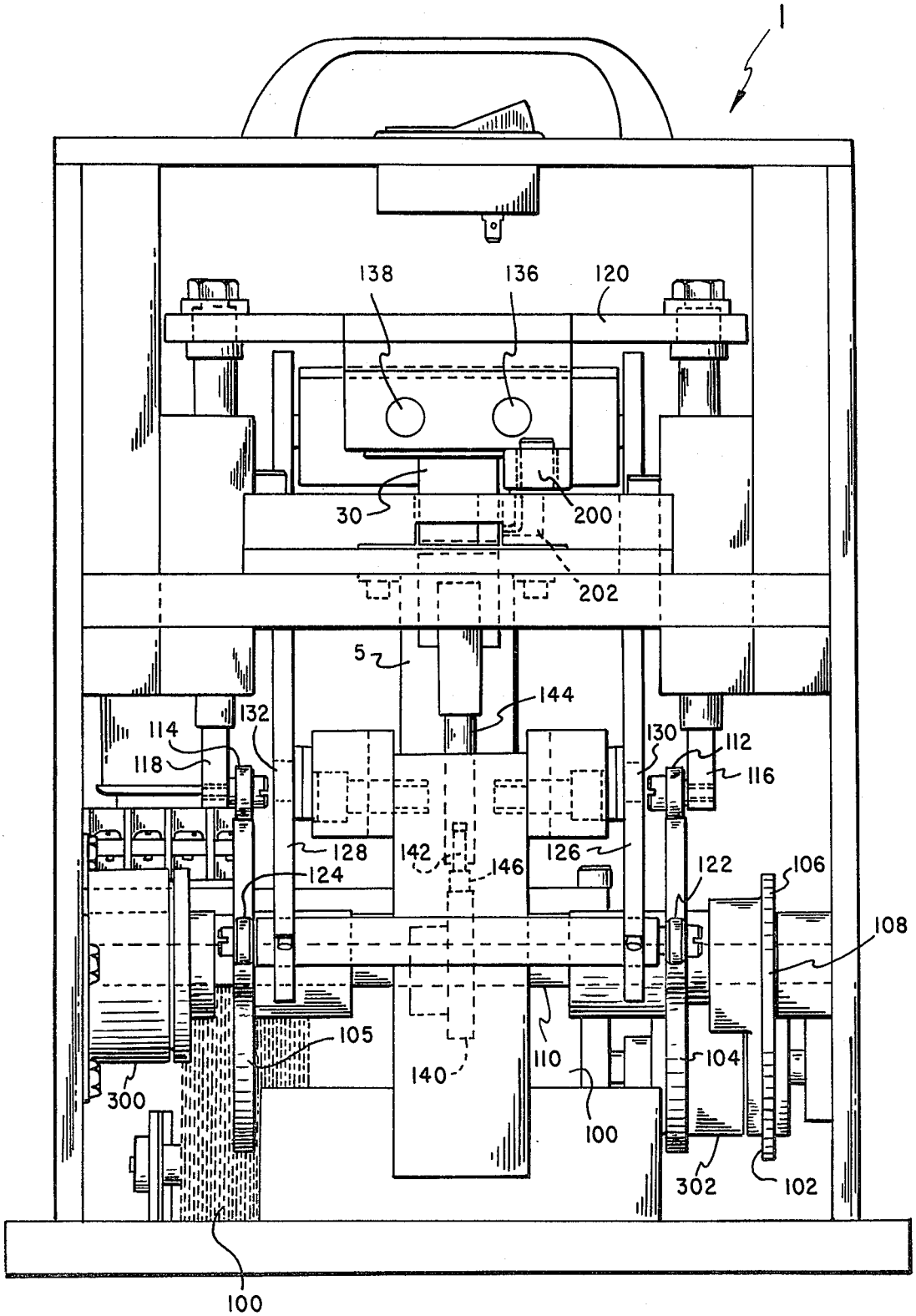
FIG. 3 is an end view of drive mechanisms shown in FIGS. 1 and 2.

FIGS. 2 and 3 illustrate in side and end view respectively, the internal drive mechanisms of the device 10. Included is a drive motor 100 having a sprocket 102 interconnected with the sprocket 108 affixed to a shaft 110 to each end of which are affixed vertical and horizontal motion cams 104, 105 by means of a drive chain 106. The cams 104, 105 have vertical motion cam riders 112, 114, each of which is affixed to a vertical motion shaft 116, 118 by means of which, as the shaft 110 and the cams 104, 105 rotate, vertical motion is imparted to the top plate 120, the die block 30 and the associated dies 24, 26, 28. Also in contact with the cam surfaces of the cams 104, 105 are horiziontal motion cam riders 122, 124, through operation of which the horizontal movement arms 126, 128 are imparted rocking motion about the pivots 130, 132, thereby causing the die block 30 and its associated dies 24, 26, 28 to move horizontally as the slider 134, moveably carried by the top plate 120, moves back and forth along the slider bars 136, 138. It should be noted in particular that cam 104 drives both vertical cam rider 112 and horizontal cam rider 122, and that cam 105 drives both vertical cam rider 114 and horizontal cam rider 124. It should also be noted that in terms of each cam, by virtue of its outer contour, its associated vertical cam rider is actuated about 90° following actuation of the associated horizontal cam rider for each rotation of the cam, with de-actuation following actuation in each case by about 180° of cam rotation. The cams 104, 105 are congruent in peripheral configuration and identically positioned with respect to the shaft 110, so that both vertical cam riders 112, 114 and shafts 116, 118 move simultaneously in the same direction, as do also the horizontal cam riders 122, 124 and their associated lever arms 126, 128. By this means, the sequence of die block and die positions hereinafter described are made possible by rotation of the cams 104, 105.

Intermediate the cams 104, 105 and affixed to the same shaft 110, is a blanking punch cam 140 having an associated blanking punch cam rider 142 at the lower end of the blanking punch shaft 144. The upper end of the shaft 144 abutts the base of the blanking punch 32 hereinafter described and, through rotation of the shaft 110 and the cam 140, causes the blanking punch 32 to thrust upward and withdraw downward as hereinafter described. It should be noted that the camming surface 146 of the cam 140 is so positioned with respect to the camming peripheral surfaces of the cams 104, 105, that the blanking punch shaft 144 will be moved upward while the die block 30 and its associated dies 24, 26, 28 are in the "down" and "front" positions as hereinafter described.

It will be apparent from the descriptions of operational sequence which follow, that it is desirable to have the die block 30 and its associated dies 24, 26, 28 in the "down" position (i.e., in closest proximity to the punching base 20), and in the "back" position (i.e., farthest from the blister pack tape ingress aperture 2) when the machine is started, as this enables the machine to cycle properly to begin its operation, and to shut off when operation is complete with the machine in the optimum position for subsequent resumption of operations.

Accordingly, as shown in FIG. 4, a microswitch 200 is so positioned with respect to the ingress slot 2 and the guides 22, 23, that when the front end of a blister pack strip 12 is inserted into the machine, it will hit against the side of the positioning die 24 which acts then as a stop, while at the same time deflecting the arm 202 of the microswitch 200, thereby, through known per se circuiting, releasing a brake 300 on the drive mechanism and engaging a clutch 302 after elapse of a time delay built into the circuiting. The time delay allows time for the stop to be hit by the tape 12 before the machine begins to operate. Further, the presence of the tape 12 as it feeds through the machine causes the arm 202 to continue to be deflected until the rear end of the tape has passed. The inherent bias of the tail 202 causes the microswitch 200 to re-actuate, disengaging the clutch and engaging the brake, so that the operational mechanism is again properly positioned in the "down" and "rear" positions for subsequent re-use, the tapes normally being perforated at uniform intervals.

Figure 5:
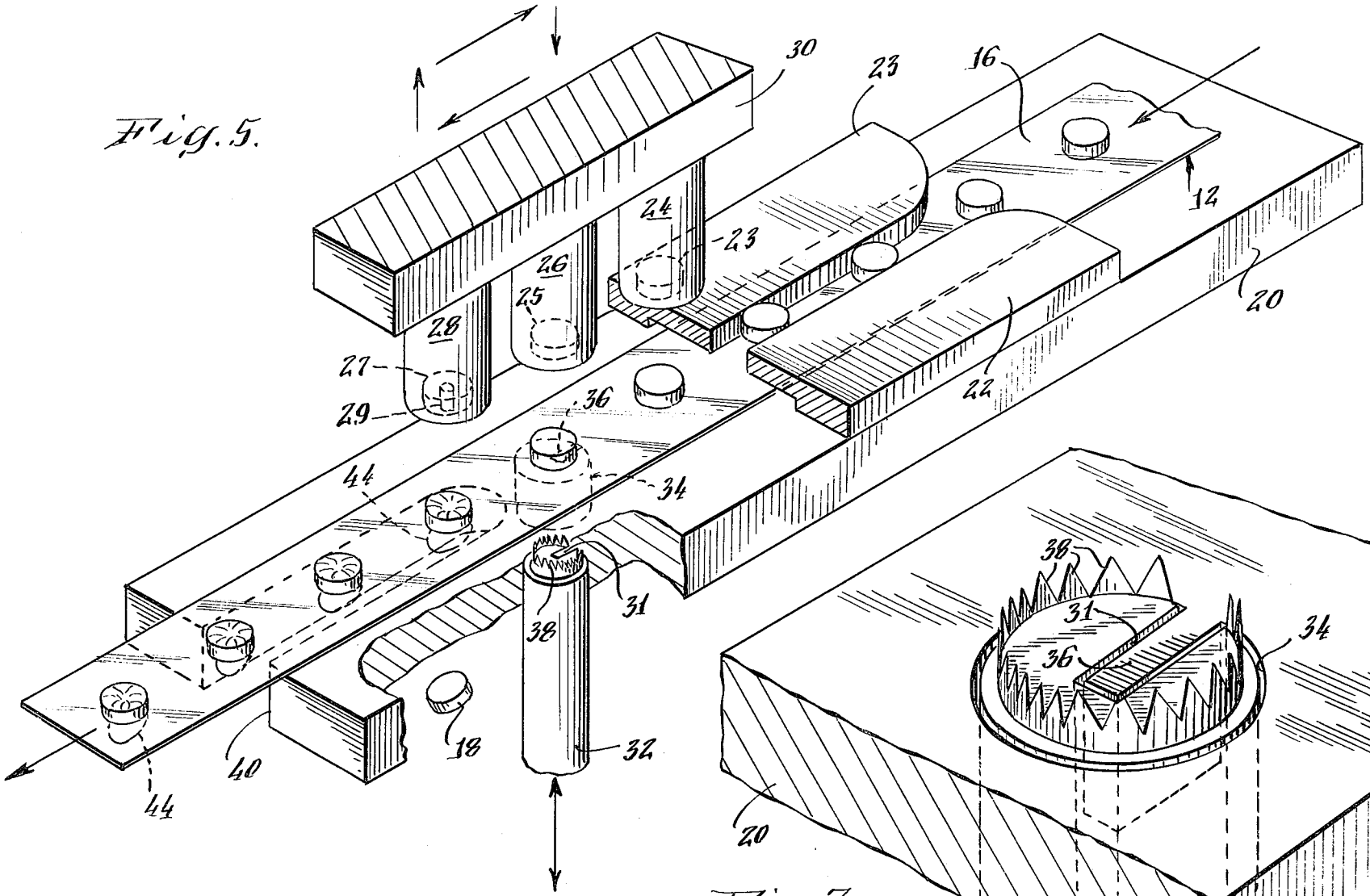
FIG. 5 is a perspective view of an embodiment of this invention.
Figure 7:
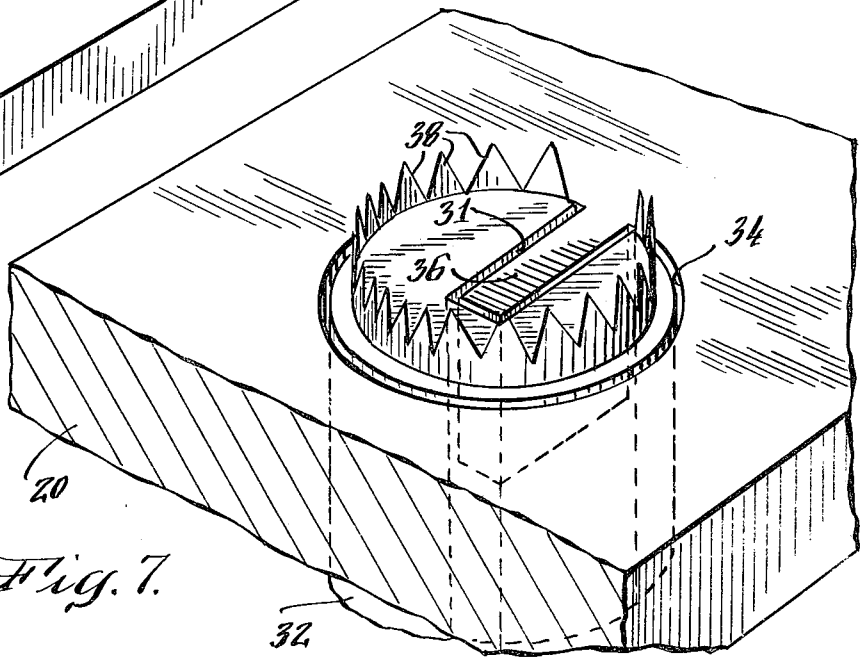
FIG. 7 is a perspective view showing the blanking punch portion of the embodiments of this invention shown in FIGS. 1 through 6(A–D).

Turning next to FIG. 5, there is depicted a perspective view of the tape processing device 10 of the embodiment of this invention herein described. The device 10 includes a base member 20 along which the strip 12 may be fed through guides 22, 23 rigidly or moveably affixed to the top of the base 20. As shown in greater detail in FIG. 5, the base 20 includes a blanking die aperture 34 and a punching die aperture 40 for use in connection with the blanking and punching die aperture 40 for use in connection with the blanking and punching operations hereinafter described.

As shown also in FIGS. 6A through 6D, the device 10 includes a positioning die 24 for properly positioning the blisters of the blister packs to facilitate the operations being carried out, by enveloping each of them as it is fed along. Since the positioning die is rigidly affixed positionally with respect to the blanking die 26 and the punching die 28 by means of the die block 30 to which all of them are attached, it is thereby assured that each blister will be properly positioned for each sequential operation as hereinafter described. The blanking die 26 has a hollowed-out seat or receptacle 25 like the seat or receptacle 23 in the positioning die 24, both of which correspond as to internal shape and dimensions more or less so as correspond to the outside of the blisters 16. Continuous contact between the interior of the aperture 25 and the exterior of the blisters 16 is not essential, however, because during the blanking operation hereinafter described the composite blister pack strip 12 is held firmly against the base 20 by the peripheral, downward-most annular projection 21 of the blanking die 26.

The punching die 28 has a corresponding aperture 27, but it has a centrally positioned punch 29 for impinging upon the top of blisters 16 so as to force the contents 18 of each pack therefrom via the aperture 42 as hereinafter described.

As previously mentioned, the base 20 includes a aperture 34 in which is positioned an upwardly oriented blanking punch 32 which has an array of cutting teeth 38 on the periphery of the top of the punch 32. The die 32 has a longitudinal slot 31 in which is positioned the tongue 36 of the base 20, the cooperative interaction of which is to guide the punch 32 when it is moved. The tongue 36 also acts as a backer to keep the flap 44, created when the aperture 42 is punched in the base 14 of the strip 12, from opening up prematurely as the punch 32 moves downward after having performed the operation of outlining the egress hole 42. The interruption in the continuity of the array of teeth 38 caused by the tongue 36 also provides a hinge 43 between the flap 44 and the base strip 14 wherein the flap 44 is retained with the remnants of the blister pack strip 12 for disposal rather than becoming totally disassociated therefrom or otherwise falling among the contents of the blister packs which are to be recovered and retained.

Figure 6A:
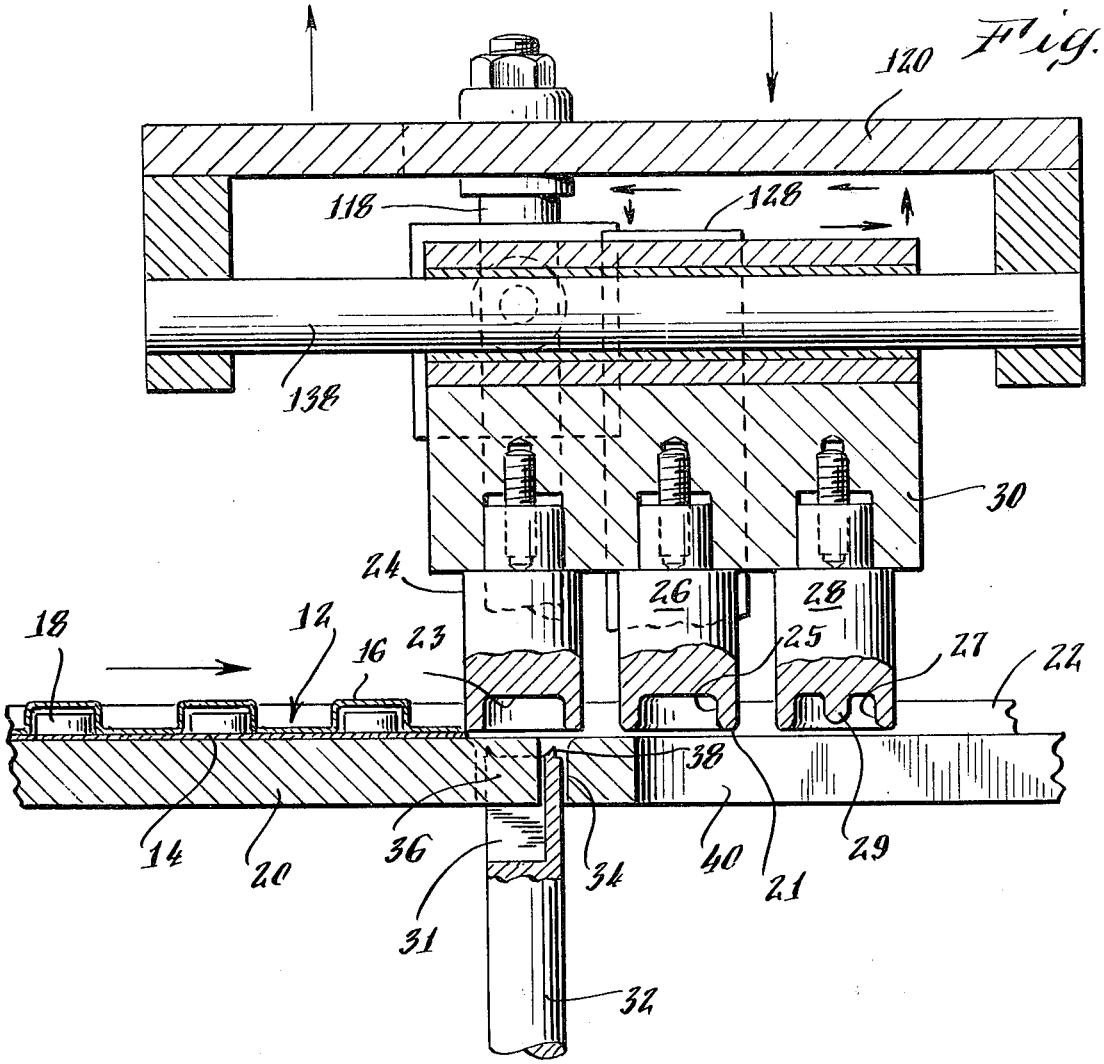
FIGS. 6A through 6D are side cross-sectional views of the embodiments of this invention shown in FIGS. 1 through 5 at successive stages of operation.
Figure 6B:
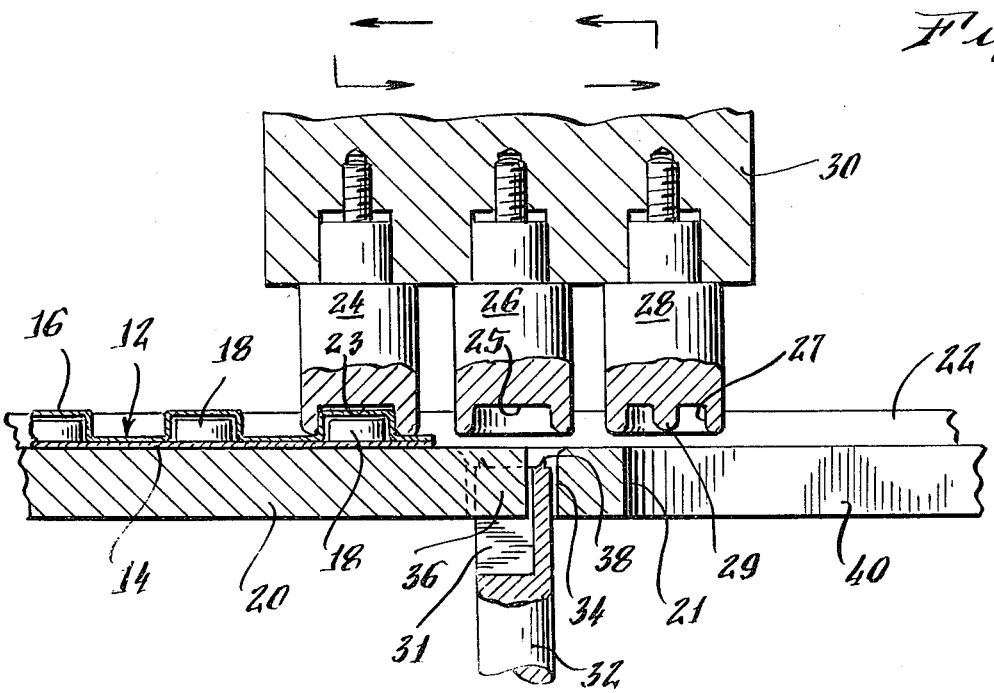

The operating sequence of the device 10 is as follows: As noted above, the normal "at rest" position of the die block and its associated dies is in the "down" and "back" position; i.e., in the position which is closest to the base 14 and farthest from ingress slot 2. As shown in FIG. 4 and described above in connection therewith, the microswitch 220 is actuated by its arm 202 being deflected upon insertion of a blister pack strip 12 until it hits a stop. In the apparatus herein disclosed, as shown in FIG. 6A, the outside of die 24 is used as the stop since it is "down" in its "at rest" position. This actuation of the machine causes the die block and its associated dies to move up, laterally toward the ingress slot 2, and down, along the paths of travel described in 2, 3, and 4 below respectively. The relative position of the various components and the blister pack strip at this point are illustrated in FIG. 6B. Thereafter, the motion pattern of the die block 39, and therefor of the dies 24, 26, 28 affixed thereto, in the orientation shown in FIGS. 6A through 6D, is as follows.

1. With the bottom ends of the dies 24, 26, 28 in proximity to the top of the base 20, and distant therefrom by approximately the combined thickness of the blister pack base 14 and the blister material 16, from left to right a distance substantially equal to the distance between centers of the blister packs, then
2. upward by a distance at least greater than the height of the tops of the blisters, then
3. while still up, left a distance substantially equal to the distance between center of the blister packs, then
4. down until the bottoms of the dies 24, 26, 28 are in proximity to the top of the base and distant therefrom by approximately the combined thickness of the blister pack base 14 and the blister material 16.
5. Step 1, etc.

Immediately following step 4 above, and before step 5 (step 1) commences, the punch 32 moves upward to cut the outline of the agress aperture 42 and associated flap 44 and back down into the base aperture 34 so that its cutting teeth 39 are below the top of the base 20 before the motion of step 5 (step 1) commences, so as not to interfere with the strip 12 being fed through the device.

Figure 6C:
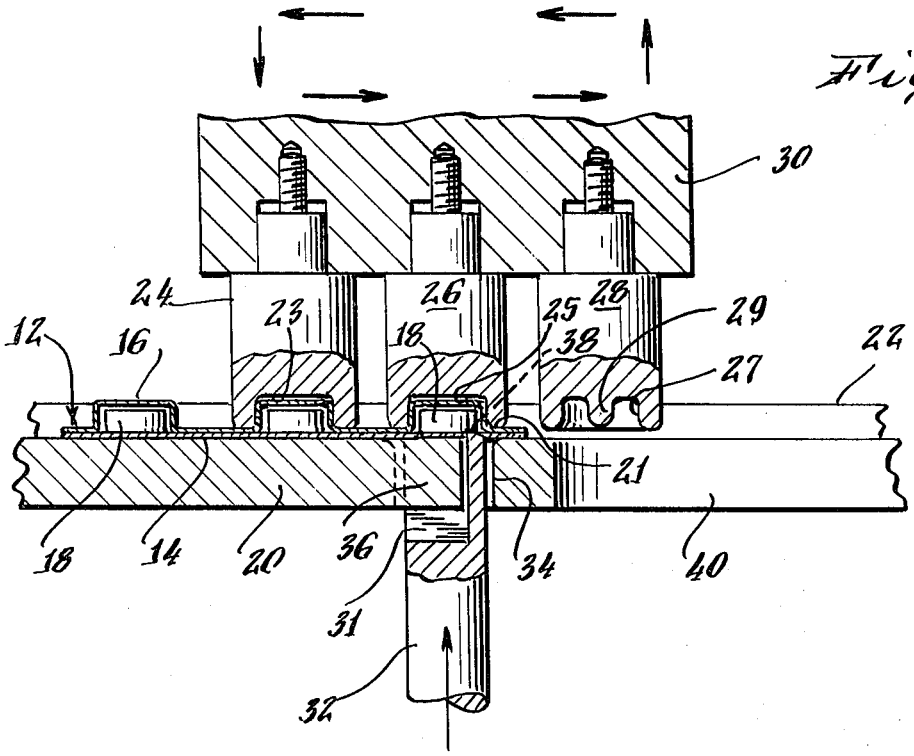
Figure 6D:
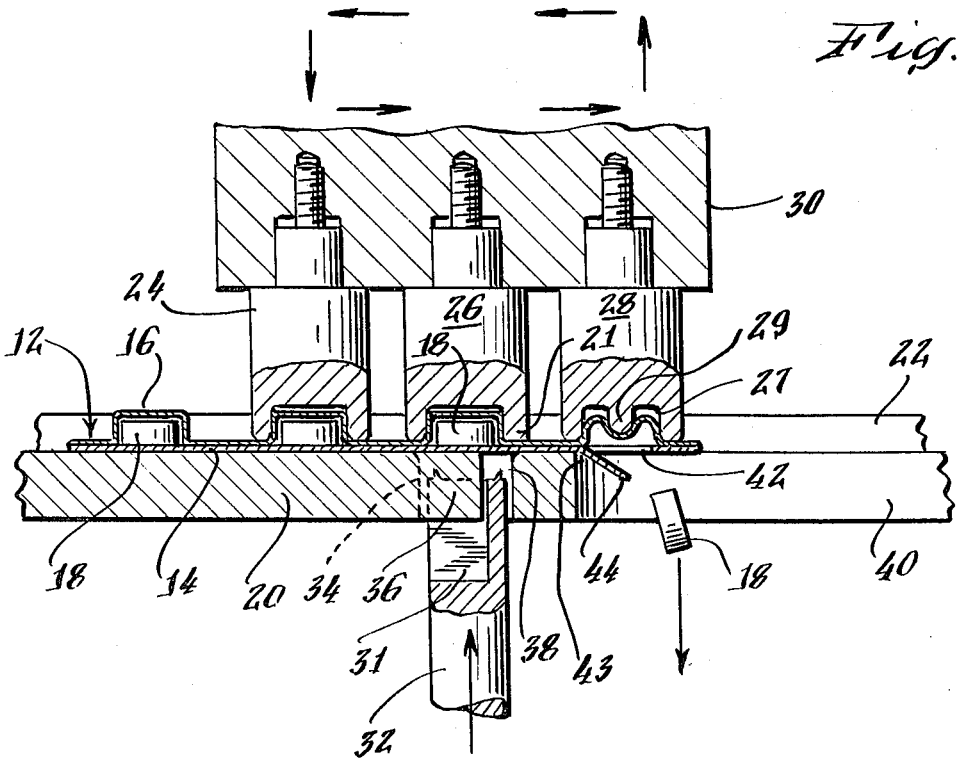

FIG. 6C represents the relative position of the various machine components and the associated blister pack strip at a point in time after the start cycle and one complete cycle, but prior to step 1 above of the next cycle. FIG. 6D is a similar representation at a point in time after step 4 of one complete cycle following that shown in FIG. 6C, and before step 5 (step 1) of the next cycle has begun, with the blanking die punch 32 in its elevated or cutting position.

It will also be apparent that upon step 4 above occurring, the blister then positioned immediately below punching die 28, having in the previous sequence had the outline of an egress hole 42 punched in the strip base 14 by the blanking punch 32, will have the top of its blister layer 16 impinged upon by the punch 29. This causes the blister to buckle and to push on the blister contents 18, causing the latter to push open the flap 44 and to fall via chute 5 into a collection box 7, which optionally may be inside the machine housing, while the depackaged tape, with the flap 44 still attached, exits from the machine for subsequent disposal.

Accordingly, each blister "sees" the following in sequence as it moves through the machine.

A. Insertion
B. Shrouding by positioning die 24 and movement forward to the hole blanking position
C. Hole blanking
D. Movement forward to the de-packaging position,
E. De-packaging by impingement of the punch 29, and
F. Removal from the machine for disposal.

The various elements of this invention may be made in any of a wide variety of configurations and shapes, and from a wide variety of materials. Thus, for example, stainless steel may be used, particularly to produce components which may come into contact with materials such as pharmaceuticals. By way of further example, the dies may be of round, square, rectangular, or other configurations. In addition, although the specific embodiment herein discosed and described is especially adapted for removing products from a continuum of packages, the principles of this invention may also be utilized with individual packages not connected together. Also, the apparatus may be made to function in an orientation other than that shown; i.e., with the dies oriented horizontally, or vertically upward, etc.

Accordingly, it is to be understood that the embodiments herein disclosed and described are by way of illustration and not of limitation, and that other embodiments may be made without departing from the spirit or scope of this invention.

I claim:

1. Apparatus for removing the contents from a packaging container comprising blanking means for blanking the outline of an egress hole in one of the walls of said container, and removal means for removing the contents of said container by impinging upon the exterior of the wall of said container that is opposite the wall in which said egress hole outline has been blanked, and for causing the wall so impinged upon to buckle inward and to push the contents from said container through said egress hole.

2. The apparatus described in claim 1 wherein the wall in which said egress hole is blanked is the base of said container.

3. The apparatus described in claim 2 wherein said blanking means comprises a blanking punch, and a blanking die for positionally holding said container against movement in response to the blanking action of said blanking punch.

4. The apparatus described in claim 3 wherein said removal means is a punching die.

5. The apparatus described in claim 4 wherein said punching die and said blanking die are in side-by-side relationship with each other, and wherein said blanking punch is opposite said blanking die and moveable toward said blanking die to effect blanking.

6. The apparatus described in claim 5 wherein said punching die and said blanking die are integral with a common motion head.

7. The apparatus described in claim 6 including motion means for causing said motion head to move said dies sequentially in a quadrilateral motion, the segments of which are (1) with the dies in their down-most position, laterally the distance between the centers of said containers in the direction of said punching die, then (2) vertically a distance higher than said container, then (3) laterally the same distance as in said first segment but counterdirectionally thereto, and then (4) downward to the position at which said first segment started.

8. The apparatus described in claim 7 wherein said blanking punch moves upward to effect blanking between the end of said fourth segment and the beginning of the segment next following.

9. The apparatus described in claim 8 including a strip bed to which the bottom ends of the punching die and of the blanking die are in close proximity in the down position and through the top surface of which said blanking punch passes when moving upward to effect blanking.

10. The apparatus described in any of claims 1 through 9 including a positioning die juxtaposed to said blanking die for positioning containers being fed into said apparatus and moving same into position to be blanked.

11. Apparatus for removing the contents of blister-packed containers which are in a continuous strip comprising a strip bed for supporting said strip as it passes through said apparatus, a die head with a centering die, a blanking die, and a removal die positiond thereon, said blanking die being opposite a blanking punch aperture in said bed when in a first position, and said removal die being opposite a removal aperture when said removal die is in said first position, each of said dies having a hollowed-out end of contours and dimensions substantially like those of the blisters from which contents are to be removed, said removal die having a removal punch positioned at the base of the hollow in its end, said die head being affixed to means for causing it to move through four sequential steps: the first being with the ends of said dies being in proximity to the top surface of said strip bed and moving in the direction from said blanking punch aperture toward said removal aperture, by a distance substantially equal to the distance between centers of said containers, the second being vertically by a distance at least as great as the height of said containers, the third being counterdirectional to the first by the same distance with the bottoms of said dies at a distance from the top of said bed greater than the height of said containers; and the fourth being downward to such an extent that the height of the base of said dies above the top of said bed is equal to that at which the first segment commenced, and blanking punch means positioned in said blanking punch aperture, oriented upward, and having means associated therewith for causing said blanking punch means to move upward after each of said fourth motion segments, and before the next of said motion segments commences.

12. Apparatus for blanking a hole in a packaging controller comprising a blanking punch having a longitudinal slot radially oriented from its peripheral wall, forming a discontinuity in the blanking surface of said blanking punch, and an associated base having an aperture therein wherein said blanking punch may be longitudinally moveably positioned, said aperture including an elongated tongue member positionable in said slot in said blanking punch, whereby an aperture may be blanked in the wall of a container leaving a hinge by which the blanked portion will remain attached to the remainder of said wall after said blanked portion is moved out of the hole thereby made in said wall.

13. A method of removing the contents of a container in a strip of containers comprising the steps of blanking an egress aperture in the base of said container.

causing a removal punch to impinge upon the top of said container, causing same to buckle downward against the contents of said container and said contents thereby to push the blanked portion out of said egress aperture and to be ejected from said container.

* * * * *